US005224702A

United States Patent [19]

Turner

[11] Patent Number: 5,224,702

[45] Date of Patent: Jul. 6, 1993

[54] OFFSET HOSEL GOLF CLUB

[76] Inventor: David A. Turner, Rte. 1, Box 489D, Diana, Tex. 75640

[21] Appl. No.: 807,147

[22] Filed: Dec. 13, 1991

[51] Int. Cl.[5] ..... A63B 53/02; A63B 53/04

[52] U.S. Cl. ..... 273/80 C; 273/167 G; 273/80.2; 273/164.1

[58] Field of Search ..... 273/80 C, 167 G, 167 H, 273/79, 164.1, 80.2-80.9, 77 R

[56] References Cited

U.S. PATENT DOCUMENTS

| | | | |
|---|---|---|---|
| 1,250,296 | 12/1917 | Fitzjohn et al. | 273/167 G X |
| 1,436,579 | 11/1922 | Dayton | 273/80 |
| 1,703,199 | 2/1929 | McClure | 273/80 C X |
| 1,792,852 | 2/1931 | Mattern | 273/80.8 |
| 2,003,951 | 6/1935 | Pepin | 273/164 |
| 2,088,095 | 7/1937 | Sargent et al. | 273/80 C |
| 2,859,972 | 11/1958 | Reach | 273/164 |
| 3,166,320 | 1/1965 | Onions | 273/80 C |
| 3,595,577 | 7/1971 | Hodge | 273/167 G X |
| 4,157,830 | 6/1979 | Taylor | 273/167 G |
| 4,693,478 | 9/1987 | Long | 273/164 |
| 4,702,477 | 10/1987 | Soloman | 273/80 |
| 4,754,976 | 7/1988 | Pelz | 273/169 |

FOREIGN PATENT DOCUMENTS

| | | | |
|---|---|---|---|
| 238646 | 10/1960 | Australia | 273/80 C |
| 899562 | 6/1962 | United Kingdom | 273/80 C |
| 2081590 | 2/1982 | United Kingdom | 273/80 C |

*Primary Examiner*—Vincent Millin
*Assistant Examiner*—Sebastiano Passaniti
*Attorney, Agent, or Firm*—John M. Harrison

[57] ABSTRACT

An angled hosel golf club wherein the hosel is located on the back of the clubhead away from the face and is angled toward the face of the clubhead at a predetermined angle which aids in preventing slicing or hooking of a golf ball. The face of the head is thus located forwardly of the hosel and the tip of the shaft extends through the hosel and clubhead to the bottom of the clubhead at a point from $1\frac{1}{4}$ to $1\frac{3}{4}$ inches to the outermost projection of the club face. The offset hosel golf club is characterized by a conventional face loft and lie and due to the offset location of the hosel on the clubhead, metal which is used to conform the club to a desired weight may be placed in the clubhead between the shaft and the face, thereby facilitating rotation of the clubhead toward the target and aiding wrist rotation at the point of impact.

8 Claims, 1 Drawing Sheet

OFFSET HOSEL GOLF CLUB

BACKGROUND OF THE INVENTION

1. Field of the Invention

This invention relates to golf clubs and more particularly, to golf club "woods", including the driver. The angled hosel golf club of this invention is characterized by a hosel connected to the clubhead at the back of the clubhead away from the face, rather than the front of the clubhead or near the face, as in conventional woods and the hosel is angled toward the face of the clubhead at a predetermined face angle. This predetermined face angle is selected to help prevent slicing or hooking, as desired, and is measured from the intersection of the club shaft and a vertical line extending through the outermost face projection, or from a vertical line projecting through the tip of the shaft at or near the bottom of the clubhead and the centerline of the shaft. In a preferred embodiment the tip of the shaft in the clubhead is about 1¼ to about 1¾ inches to the outermost projection of the face. This positioning of the hosel and shaft in angular relationship with respect to the face of the clubhead insures that the golfers' hands are always located ahead of the ball on impact when the club is swung, except where the angle of inclination of the shaft is 0.

Conventional golf club "woods", including the driver, are designed such that the hosel is located near the face of the club. In fact, on most conventional woods, the face is set at a standard loft angle and is a continuation of the hosel at the heel of the club and the tip of the shaft extends to near the bottom of the clubhead approximately 0.75 inches from the centerline of the shaft to the outermost part of the face. These clubs are also characterized by a standard lie, which is generally about 55 degrees. Accordingly, when conventional "wood" clubs are oriented such that the shaft is in a horizontal plane with the club face directed toward the target, the clubhead will rotate in the clockwise direction, away from the target, when viewed from the grip. In contrast, when placed in the same position, the clubhead of the angled hosel golf club of this invention will rotate in a counterclockwise direction, toward the target, when viewed from the grip. This weighting of the offset hosel golf clubhead and orientation of the shaft and hosel with respect to the clubhead at a selected face angle, or the angle measured between the vertical at the club face and the centerline of the club shaft or between the vertical and shaft at the clubhead, aids in rotation of the wrists to follow through at the end of the driving swing.

2. Description of the Prior Art

Conventional "wood" golf clubs are designed with more or less standard lie and face loft and the hosel, or shaft mount is attached to the clubhead at the face and heel of the club such that the face is substantially molded into the hosel. The center of gravity of the conventional clubhead is thus positioned rearwardly of the point of attachment of the shaft and hosel to the clubhead.

Golf clubs of various design have long been known in the art. U.S. Pat. No. 1,436,579, dated Nov. 21, 1922, to C. W. Dayton, details a "Golf Club" wherein the shaft and clubhead extend at an acute angle with respect to each other. The clubhead is constructed of wood or metal and a base is secured to the underface of the clubhead, which base gradually decreases in thickness toward each end and side, to present a rounded surface at the underface of the clubhead. The clubhead further includes multiple striking faces located on both sides and at the rear area. U.S. Pat. No. 4,693,478, filed Mar. 17, 1986, to D. C. Long, details a "Golf Putter Head", wherein the mass of the head is distributed to establish a locus for the center of mass approximately one-half of the way along the length of the blade. U.S. Pat. No. 4,702,422, filed Jul. 26, 1985, to James R. Soloman, details another "Golf Putter" characterized by a head having a heel, toe and multiple surfaces, including a planar striking surface, a rear surface and a sole surface extending between the planar striking surface and the rear surface. U.S. Pat. No. 4,754,976, dated Jul. 5, 1988, to Pelz, entitled "Putter", includes a head, shaft and a ball-striking face having a center of mass disposed at least 10 centimeters behind the striking face to create an improved effective polar moment of inertia. The design also includes a "shaft force axis" disposed at a position relative to the center of mass to create a "self-aligning" stability force throughout the acceleration portion of the putting stroke. Another "Golf Putter" is detailed in U.S. Pat. No. 4,702,477, dated Oct. 27, 1987, to James R. Soloman. The golf putter includes a head having a planar striking surface and a horizontal extension from the head positions the shaft in a vertical plane, one-half to two inches rearwardly of the head. The extension provides the connecting link between the shaft and the rear surface of the head and locates the center-of-gravity of the head between the shaft and the ball to be stroked when the head is in the striking position relative to the ball. U.S. Pat. No. 4,852,877, dated Aug. 1, 1989, to John H. Scalf, details yet another "Golf Putter". The putter includes a putter head having vertical impact face and an elongated shaft member angularly disposed in an offset relationship in two distinct planes relative to the flat rear surface of the putter head, such that a golf ball may be propelled toward the golf cup in shuffleboard fashion. Another "Golf Club" is detailed in U.S. Pat. No. 4,921,253, dated May 1, 1990, to Charles A. Tesori. The clubhead assumes an L-shaped configuration which is symmetrical about a vertical axis and includes a vertical wall having a horizontally-disposed top surface and a horizontal wall extending behind the vertical wall. A center flange is located behind the vertical wall and contains a top surface that is coplanar with the top surface of the vertical wall and a pair of end flanges are located at the toe and heel ends of the horizontal wall immediately behind the front wall. A vertically-disposed slot extends downwardly between the vertical front wall and the three flanges to a depth such that the effective center of mass at the front striking face of the club lies below the center of a golf ball. The shaft of the golf club projects downwardly into the center flange of the clubhead and is positioned immediately behind the vertical wall of the club, at about the effective center of mass. The club can thus be swung like a pendulum through an arc that lies in the plane of intended travel of the golf ball to impart overspin on the ball.

It is an object of this invention to provide an angled hosel golf club wherein the hosel is attached to the clubhead in spaced, angular relationship with respect to the club face.

Another object of the invention is to provide an angled hosel golf club wherein the hosel is attached to the clubhead at a point from about 1¼ inches to about 1¾ inches from the point of termination of the shaft in the clubhead to the outermost projection at the base of the face at a selected angle, to facilitate location of the hands ahead of the ball on impact when the club is swung.

Another object of this invention is to provide a "wood" golf club wherein the hosel is mounted on the clubhead at a point measuring about $1\frac{1}{4}$ inches to about $1\frac{3}{4}$ inches from the centerline of the shaft in the clubhead to the outermost projection of the club face at a selected face angle to help prevent slicing and hooking, depending upon the chosen face angle.

A still further object of this invention is to provide an offset hosel golf club which is characterized by a club shaft terminated in the clubhead near the back of the club at a point from about $1\frac{1}{4}$ inches to about $1\frac{3}{4}$ inches from the centerline of the shaft to the outermost part of the face at a selected face angle, wherein the club head rotates toward the target when the shaft is oriented in a horizontal plane.

SUMMARY OF THE INVENTION

These and other objects of the invention are provided in an offset hosel golf club which is characterized by a hosel located from about $1\frac{1}{4}$ to about $1\frac{3}{4}$ inches from the centerline of the farthest point of extension of the club shaft into the clubhead to the outermost projection of the face and at selected inclination toward the face, which inclination is measured between a vertical line through the outermost projection of the face and the centerline of the shaft or between a vertical line through the tip of the shaft in the clubhead and the shaft itself, to locate the hands ahead of the ball and aid in preventing slicing and hooking of the ball.

BRIEF DESCRIPTION OF THE DRAWING

The invention will be better understood by reference to the accompanying drawing, wherein.

DESCRIPTION OF THE PREFERRED EMBODIMENTS

Figure 1:
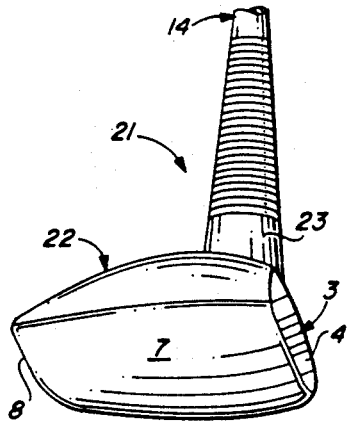
FIG. 1 (PRIOR ART)
FIG. 1 is a perspective view of the toe of a conventional golf club wood well known in the art.
Figure 2:
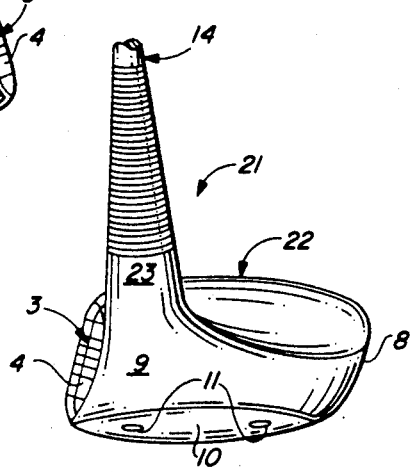
FIG. 2 (PRIOR ART)
FIG. 2 is a perspective view of the heel of the conventional golf club wood illustrated in FIG. 1.

Referring initially to FIGS. 1 and 2 of the drawings, the conventional clubhead 22 of a conventional golf club 21 is illustrated, and a conventional golf club hosel 23 extends from the conventional clubhead 22 and receives a shaft 14 at a conventional lie as an extension of the face 3, at the heel 9. Accordingly, it will be noted from a consideration of FIG. 1 that the major portion of the conventional clubhead 22 lies rearwardly of the point of attachment of the hosel 23 toward the back 8 in the conventional clubhead 22. The conventional clubhead 22 also includes a sole plate 10, mounted on the clubhead 22 by means of plate screws 11, as illustrated in FIG. 2.

Figure 3:
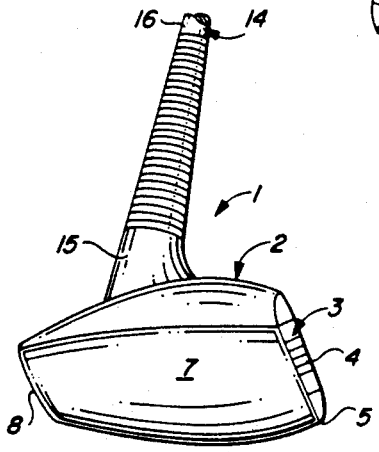
FIG. 3 is a perspective view of the toe of the angled hosel golf club of this invention.
Figure 4:
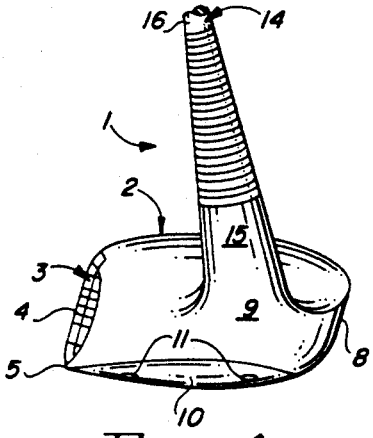
FIG. 4 is a perspective view of the heel of the angled hosel golf club illustrated in FIG. 3.
Figure 5:
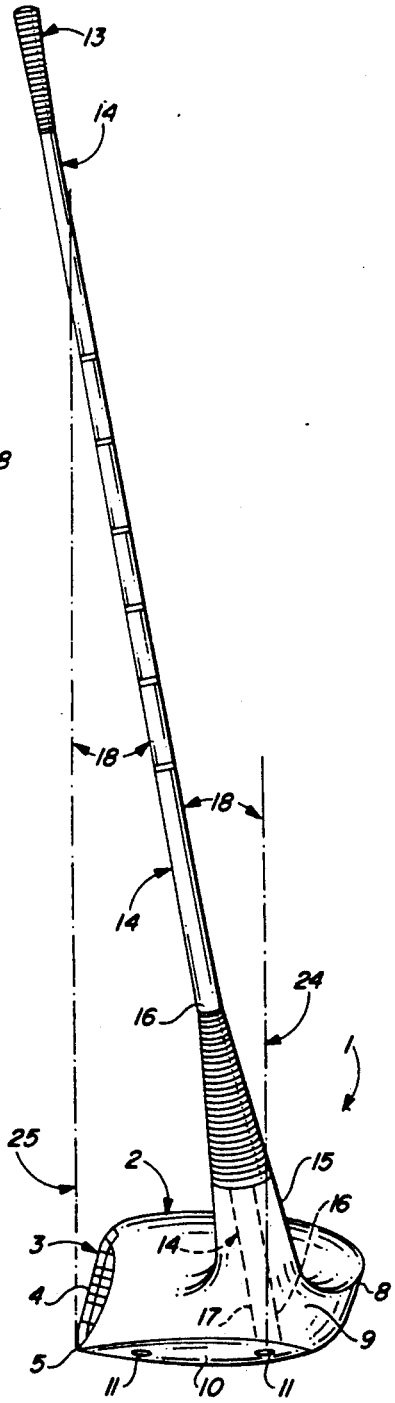
FIG. 5 is a perspective view of the heel and entire offset angled golf club, more particularly illustrating a typical face angle.

Referring now to FIGS. 3-5 of the drawings, in a preferred embodiment the angled hosel golf club of this invention is generally illustrated by reference numeral 1. The angled hosel golf club 1 includes a clubhead 2, having a conventional face 3, provided with a conventional face insert 4 and characterized by a protruding face base or leading edge 5. Both the toe 7 and back 8 of the clubhead 2 are also shaped in conventional fashion, as are the heel 9 and the sole plate 10, as illustrated. However, as further illustrated in FIGS. 4 and 5, the hosel 15 projects from the heel 9 of the clubhead 2 in spaced relationship with respect to the face 3 and receives the proximal end 16 of the shaft 14 for mounting the shaft 14 in the hosel 15. The proximal end 16 of the shaft 14 projects through the hosel 15 and into the clubhead 2 and terminates at a terminal point 17, which lies above the sole plate 10 of the clubhead 2, as illustrated in FIG. 5. Furthermore, referring again to FIG. 5, the hosel 15 is inclined toward the face 3 at a face angle 18, which is measured between the shaft 14 and a vertical shaft line 24, which intersects the proximal end 16 of the shaft 14 at the terminal point 17. Moreover, this face angle 18 may also be measured between a vertical face line 25 which extends through the outermost projection of the face 3 at the face leading edge 5 and the shaft 14. It will be appreciated by those skilled in the art that the face angle 18 of the shaft 14 and hosel 15 may vary, depending upon whether it is desired to "open" or "close" the face 3 of the angled hosel golf club 1. In a preferred embodiment of the invention, the distance between the terminal point 17 of the proximal end 16 of the shaft 14 and the face leading edge 5 of the face 3 in the angled hosel golf club 1 is in the range of from about $1\frac{1}{4}$ inches to about $1\frac{3}{4}$ inches and in a most preferred embodiment, this distance is about $1\frac{1}{2}$ inches. Under circumstances where the distance between the terminal point 17 and face leading edge 5 is $1\frac{1}{2}$ inches and the vertical face line 25 intersects the shaft 14, preferred angles of inclination of the shaft 14, or the face angle 18, as well as corresponding lengths of the vertical face line 15, may be tabulated as follows:

| SHAFT ANGLE (Degrees) | DISTANCE TO INTERSECTION OF SHAFT (Inches) |
|---|---|
| 0.00 | 0.00 |
| 0.50 | 171.89 |
| 1.00 | 85.95 |
| 1.50 | 57.30 |
| 2.00 | 42.98 |
| 2.50 | 34.39 |
| 3.00 | 28.66 |
| 3.50 | 24.57 |
| 4.00 | 21.50 |
| 4.50 | 19.12 |
| 5.00 | 17.21 |
| 5.50 | 15.65 |
| 6.00 | 14.35 |
| 6.50 | 13.25 |
| 7.00 | 12.31 |
| 7.50 | 11.49 |
| 8.00 | 10.78 |
| 8.80 | 10.15 |
| 9.00 | 9.59 |
| 9.50 | 9.09 |
| 10.00 | 8.64 |
| 10.50 | 8.23 |
| 11.00 | 7.86 |
| 11.50 | 7.52 |
| 12.00 | 7.21 |
| 12.50 | 6.93 |
| 13.00 | 6.67 |
| 13.50 | 6.43 |
| 14.00 | 6.20 |
| 14.50 | 5.99 |
| 15.00 | 5.80 |

Accordingly, it will be further appreciated by those skilled in the art that for each "shaft angle", or face angle 18, there is a corresponding "distance to intersection of shaft", the notation of which is indicated in FIG. 5 of the drawing as the vertical face line 25. The vertical face line 25 extends vertically, away from the plane of the face 3, which plane is normally the conventional loft of the face 3, and intersects the shaft 14 at a point above the hosel 15. Accordingly, referring again to the tabulated data, if the hosel 15 and shaft 14 are provided in the clubhead 2 at an angle of 10 degrees, the distance along the length of the vertical face line 25 from the face leading edge 5 of the face 3 to the shaft 14 is 8.64 inches. It is apparent from a consideration of the tabulated data that the more acute the face angle 18, the shorter the vertical face line 25 as the face 3 is "closed", in golfing terminology. In contrast, the larger the acute face angle 18, the longer the vertical face line 25, to "open" the face 3.

It has surprisingly been found that "closing" and "opening" the face 3 by varying the face angle 18 in the angled hosel golf club 1 operates to greatly aid in the prevention of slicing and hooking of a golf ball. Specifically, it has been found that the larger the face angle 18, the less the likelihood of slicing the golf ball, while the smaller face angles 18, up to an angle of zero degrees, greatly prevent hooking of the golf ball. Furthermore, when one or more conventional head weights (not illustrated) are placed in the clubhead 2 between the vertical shaft time 24 and the vertical face line 25, it will be appreciated from a consideration of FIG. 4 that the center of gravity of the clubhead 2 also lies within this area. Accordingly, horizontal orientation of the angled hosel golf club 1 creates a tendency for the clubhead 2 to rotate toward the target in the counterclockwise direction as the club is viewed from the grip 13, thereby aiding in rotation of the wrist at the point of impact when a golf ball is struck by the clubhead 2. This wrist rotation is well known to improve the swing and driving characteristics of the ball. In contrast to this rotational tendency, and as above noted, when held in the same relative position, the conventional clubhead 22 will rotate in the clockwise direction away from the direction of desired wrist rotation at the point of impact when striking a golf ball. This rotation is counterproductive to optimum driving of a golf ball.

In a most preferred embodiment of the invention, the lie of the shaft 14 and loft of the face 3 and face insert 4 in the angled hosel golf club are conventional in design and magnitude. However, as noted above, the hosel 15 and shaft 14 are angled from the clubhead 2 toward the face 3 at a face angle 18 which varies with the desire to either "close" or "open" the face 3 and thereby minimize slicing or hooking of the golf ball. Moreover, the clubhead 2 may be constructed of any desired material, including metal, plastic, graphite, fiberglass, Kenlar or wood, in non-exclusive particular.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An angled hosel golf club of the wood type comprising:

a clubhead having a bottom portion, a face shaped in said clubhead at a selected positive loft angle for contacting a golf ball, a toe portion and a heel portion; said face having an outermost projection; a hosel carried by the heel portion of said clubhead in spaced relationship with respect to a plane containing said face; said hosel being inclined toward said face; and a shaft carried by said hosel; said shaft having one end projecting through said clubhead and terminating substantially at said bottom portion of said clubhead wherein the terminal end of a centerline projecting linearly through said hosel and said shaft and intersecting said bottom portion is located a horizontal distance in the range from about $1\frac{1}{4}$ inches to about $1\frac{3}{4}$ inches from a first vertical line extending through said outermost projection of said face; said shaft having an opposite end projecting linearly from said hosel at a preselected angle greater than zero with respect to a second vertical line extending through said clubhead at said one end of said shaft; said first vertical line extending upwardly and intersecting said angled shaft to define a predetermined vertical distance between said bottom portion and the intersection of said opposite end of said shaft and said first vertical line, whereby said preselected angle and said predetermined vertical distance are selected such that said clubhead tends to rotate toward an intended target in the counterclockwise direction as the club is viewed by a golfer in the address position at the point of impact when said clubhead strikes a golf ball.

2. The angled hosel golf club of claim 1 wherein said preselected angle is in the range from greater than 0 degrees to about 15 degrees.

3. The angled hosel golf club of claim 2 wherein said selected horizontal distance is about $1\frac{1}{2}$ inches.

4. An angled hosel golf club of the wood type comprising:

a clubhead having a bottom portion, a face shaped in said clubhead at a selected positive loft angle for contacting a golf ball, and a heel portion; said face having an outermost projection; a hosel carried by the heel portion of said clubhead in spaced relationship with respect to a plane containing said face; said hosel being inclined toward said face; and a shaft carried by said hosel, wherein the terminal end of a centerline projecting linearly through said hosel and said shaft and intersecting said bottom portion is located a horizontal distance in the range from about $1\frac{1}{4}$ inches to about $1\frac{3}{4}$ inches from a first vertical line extending through said outermost projection of said face; said shaft having an opposite end projecting linearly from said hosel at a preselected angle greater than zero with respect to a second vertical line extending through said clubhead at said one end of said shaft; said first vertical line extending upwardly and intersecting said angled shaft to define a predetermined vertical distance between said bottom portion and the intersection of said opposite end of said shaft and said first vertical line, whereby said preselected angle and said predetermined vertical distance are selected such that said clubhead tends to rotate toward an intended target in the counterclockwise direction as the club is viewed by a golfer in the address position at the point of impact when said clubhead strikes a golf ball.

5. The angled hosel golf club of claim 4 wherein said preselected angle is in the range of from greater than 0 degrees to about 15 degrees.

6. The angled hosel golf club of claim 4 wherein said horizontal distance is about 1½ inches.

7. The angled hosel golf club of claim 4 wherein said preselected angle is in the range from about 2 degrees to about 12 degrees.

8. The angled hosel golf club of claim 4 wherein said preselected angle is in the range of from about 3 degrees to about 10 degrees.

* * * * *